United States Patent [19]

Aoki

[11] Patent Number: 4,753,084

[45] Date of Patent: Jun. 28, 1988

[54] REFRIGERATED DISPLAY CABINET

[75] Inventor: Shigeki Aoki, Maebashi, Japan

[73] Assignee: Sanden Corporation, Gunma, Japan

[21] Appl. No.: 33,223

[22] Filed: Apr. 2, 1987

[30] Foreign Application Priority Data

| | | | |
|---|---|---|---|
| Apr. 3, 1986 | [JP] | Japan | 61-48928[U] |
| Apr. 3, 1986 | [JP] | Japan | 61-48929[U] |
| Apr. 7, 1986 | [JP] | Japan | 61-51794[U] |
| Apr. 15, 1986 | [JP] | Japan | 61-56563[U] |
| Apr. 15, 1986 | [JP] | Japan | 61-56564[U] |

[51] Int. Cl.[4] ..... A47F 3/04

[52] U.S. Cl. ..... 62/246; 49/425; 62/248; 312/138 R; 312/296

[58] Field of Search ..... 62/246, 248, 275; 312/138 R, 296; 220/345, 351, 84; 49/411, 425, 484

[56] References Cited

U.S. PATENT DOCUMENTS

| | | | |
|---|---|---|---|
| 2,801,450 | 8/1957 | Funke | 49/484 X |
| 3,177,924 | 4/1965 | McPhail | 49/484 X |
| 3,442,052 | 5/1969 | Levine | 49/425 |
| 3,729,243 | 4/1973 | Musgrave et al. | 312/296 X |
| 3,975,881 | 8/1976 | Ninowski, Jr. | 49/425 X |
| 4,330,310 | 5/1982 | Tate, Jr. et al. | 62/275 |

*Primary Examiner*—William E. Tapolcai

*Attorney, Agent, or Firm*—Banner, Birch, McKie & Beckett

[57] ABSTRACT

There is disclosed a refrigerated display cabinet having a refrigerating chamber and a mechanical chamber, and an access opening into the refrigerating chamber that is adapted to be opened and closed by a transparent cover panel sliding longitudinally of the access opening. The cover panel is mounted on guide rail mechanisms each of which comprise a frame with wheels and rail elements. Each frame is provided with two sealing flanges which extend vertically and horizontally from one edge of the frame into sealing engagement with the rail element when the transparent cover panel is closed thereby closing or sealing the gap between the frame and the rail elements to prevent leakage of cooled air from the refrigerating chamber.

4 Claims, 5 Drawing Sheets

REFRIGERATED DISPLAY CABINET

BACKGROUND OF THE INVENTION

This invention relates to a refrigerated display cabinet and, more particularly, to means for providing a more efficient seal for the cover panel that closes the access opening of the cabinet.

Refrigerated display cabinets that are used in stores for storing and displaying refrigerated products comprise a refrigerating chamber for the merchandise and a mechanical chamber that contains the refrigerating apparatus. The refrigerating chamber has an access opening at its upper portion for withdrawing and loading merchandise, and this opening is normally closed by glass panels for controlling the temperature in the refrigerating chamber while providing for display of the merchandise.

In cabinets of this nature, there has heretofore been provided guide rail mechanisms for the glass panels to provide for sliding the glass panels endwise of the cabinet to open and close the access opening. To reduce leakage of air into and out of the refrigerating chamber, the glass panels are provided with sealing means in the gap at the guide rail mechanism which supports the glass panels.

Referring to FIG. 1, which is a partial cross-sectional view illustrating a prior structure, there are provided guide rail mechanisms 31*a*′ and 31*b*′ for supporting a pair of glass panels 30′ at the top and bottom edges thereof for endwise sliding movement. The guide rail mechanism 31*a*′ and 31*b*′ comprise, respectively, rail elements 311*a*′ and 311*b*′ fixed to the walls of the cabinet along the edges of the transparent panels 30′. The rail element 311*a*′ and 311*b*′ are each provided with a horizontal flat running surface for the wheels 314′ of each of the transparent panels 30′, the wheels 314′ being rotatably supported on the frame 312′ whereby the transparent panels 30′ are adapted to be moved relative to each other longitudinally of the cabinet.

The running surfaces of the rail elements 311*a*′ and 311*b*′ are formed with depressions 37′ in which the wheels 314′ are adapted to be seated individually when the glass panels 30′ are in their closed positions. Also, each of the frames 312′ is provided with a sealing element 50′ that depends vertically from the edge thereof and is adapted to contact the upper surface of the horizontal running surface when the glass panels 30′ are closed and the wheels 314′ of frame 312′ are thus positioned in the depressions 37′ to provide sealing for the rail elements 311*a*′ and 311*b*′ with the frames 312′. However, if the frames 312′ were not made sufficiently accurate or if the sealing element 50′ are worn due to sliding contact against the rail elements 311*a*′ and 311*b*′ the sealing elements 50′ will not seal against the seal elements 311*a*′ and 311*b*′.

Furthermore, electrical heaters 45′ are disposed on the rail elements 311*a*′ and 311*b*′ to prevent freezing the wheels 314′ to the frames 312′ or to the rail elements 311*a*′ and 311*b*′. The rail element 311*b*′ at the front of the glass panels 30′ is positioned on panel 131′ on the upper edge of the front wall 13′ of the cabinet and the heaters 45′ are normally disposed beneath the panel 131′ to avoid being submerged in the water that condenses on the glass panels 30′ and drain into the rail element 311*b*′.

SUMMARY OF THE INVENTION

It is a primary object of this invention to provide an improved refrigerated display cabinet having an effective sealing means for preventing leakage of air around the glass panels.

It is another object of this invention to provide a refrigerated display cabinet having parts that are common to the cabinets as heretofore made and thus reduce the costs of the cabinet.

It is still another object of this invention to provide a refrigerated display cabinet in which sliding of the glass cover panels is assured at all times.

A refrigerated display cabinet in accordance with this invention includes a refrigerating chamber where the goods are stored and displayed which is defined by a front wall and rear wall, a bottom wall connected between lower portions of the front and rear walls, a pair of side walls and an upper wall to partially cover the upper portion of the refrigerating chamber, and a mechanical chamber in which a refrigerating apparatus is located. An access opening for the refrigerating chamber is adapted to be covered by a pair of movable transparent cover panels which are slidably supported on the upper and front walls of the cabinet through guide rail mechanisms including frames attached on the horizontal edges of the transparent cover panel and rotatably supporting wheels that in turn support the cover for sliding, and rail elements affixed on the front edge of the upper wall and the upper edge of the front wall of the cabinet on which the wheels are adapted to run. Each of the frames is provided with two sealing flanges extending from the edge thereof, one of the sealing flanges being arranged vertically and the other being arranged horizontally. The two flanges are adapted to contact the surface of the respective rail elements when the transparent cover panels are closed and thereby seal the refrigerating chamber against air leakage.

Further objects, features and other aspects of this invention will be understood from the following description of the preferred embodiment of this invention referring to the attached drawings.

DETAILED DESCRIPTION OF THE PREFERRED EMBODIMENT

Figure 1:
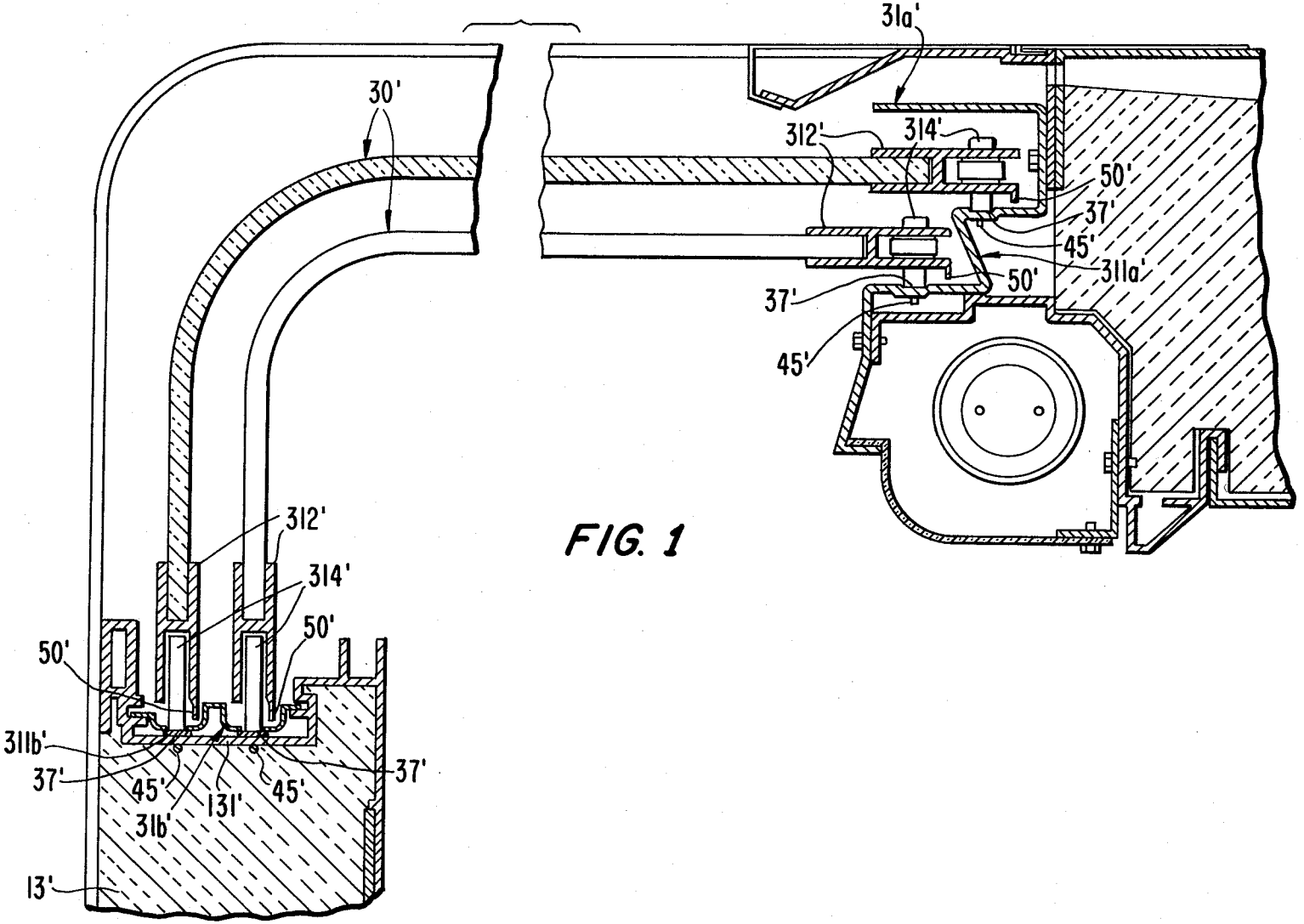
FIG. 1 is a cross-sectional view illustrating a prior structure of a guide rail mechanism for a refrigerated display cabinet.
Figure 2:
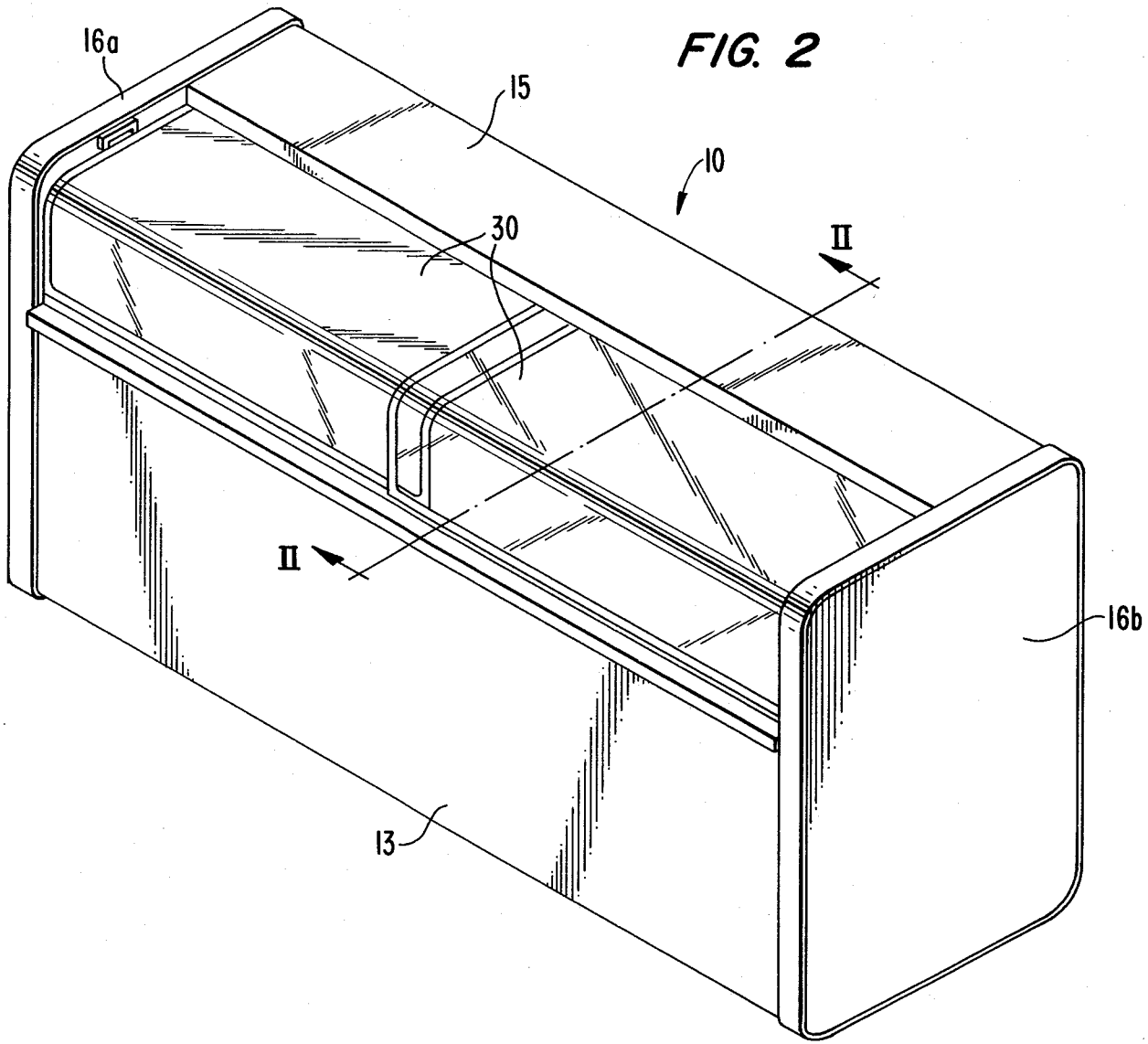
FIG. 2 is a perspective view of a refrigerated display cabinet in accordance with this invention.
Figure 3:
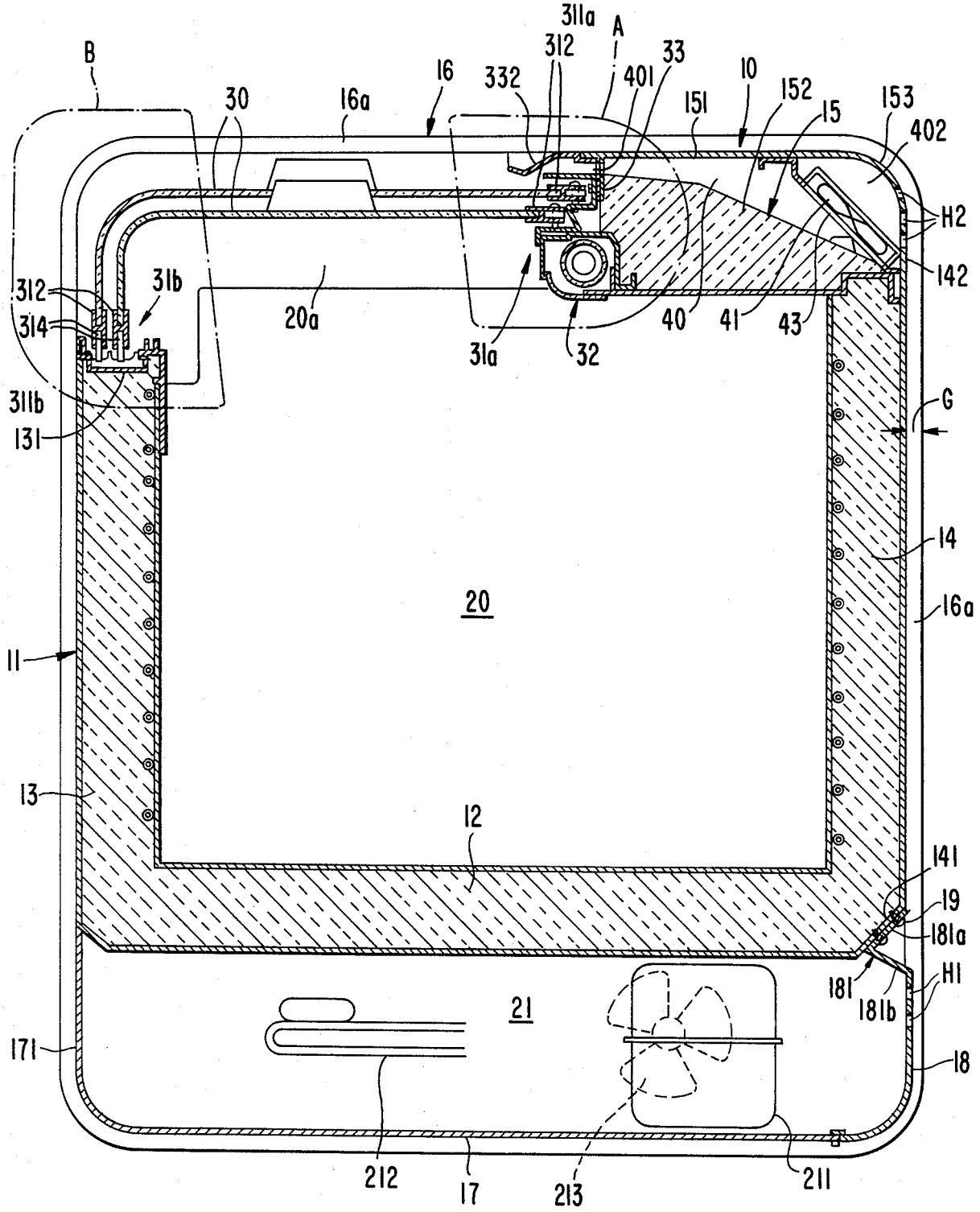
FIG. 3 is a vertical sectional view taken along the line II—II in FIG. 2.

Referring to FIGS. 2 and 3, a refrigerated display cabinet 10 in accordance with the present invention is shown. The refrigerated display cabinet 10 has a refrigerating chamber 20 and a mechanical chamber 21 in the upper and lower portion thereof, respectively. Refrigerating chamber 20 is suitably secured within a cabinet 11 and has a bottom insulated wall 12 disposed above the base of the cabinet 11 and defining the top of the mechanical chamber 21. The refrigerating chamber 20 also includes an insulated front wall 13 and an insulated rear wall 14 terminating at its upper end in an overhanging upper wall 15 which extends forwardly to partly cover the upper or access opening 20*a* of the refrigerating chamber 20. The ends of the refrigerating chamber 20 are closed by insulated end walls 16*a* and 16*b*.

The upper or access opening 20*a* of the refrigerating chamber 20 is covered by two transparent, preferably glass, covered panels 30 that are slidably supported at their edges longitudinally of the cabinet on the upper wall 15 and the front wall 13 through guide rail mechanisms 31*a* and 31*b*, respectively. The details of these transparent cover panels 30 and the guide rail mechanisms 31*a* and 31*b* are described hereinafter. The interior of the refrigerating chamber 20 is illuminated by an illuminating means 32 to display the merchandise therein more effectively.

Mounted on the bottom plate 17 of the cabinet 11 in the mechanical chamber 21 are various elements of the refrigerating apparatus other than the evaporators, such as a compressor 211 and a condenser 212. In the usual manner, gaseous refrigerant is compressed by compressor 211 and is then passed through the condenser 212 where it is cooled and condensed to a liquid. Air is drawn over the condenser 212 by a blower 213 to remove heat.

A front plate 171 is integral with and extends upwardly from the front end portion of the bottom plate 17 to cover the front of the mechanical chamber 21. The rear of the mechanical chamber 21 is closed by a lower rear plate 18, the lower edge of which is affixed to the rear edge of the bottom plate 17. The upper edge of the lower rear plate 18 is formed with a V-shaped depression 181, one side 181*a* of which is affixed to a beveled portion 141 of the outer plate 142 of the rear wall 14 by rivets 19. Holes H1 are formed through the lower rear plate 18 including holes H1 in the side 181*b* of the V-shaped depression 181 to provide for the circulation of air therethrough.

In the construction of the refrigerated display cabinet, the outer plate 142 of the rear wall 14 and lower rear plate 18 are in the same vertical plane which is spaced from the vertical plane defined by the rear edge of the side walls 16 and define a gap G between the planes. The rear of the cabinet 11 thus consists of flat surface defined by the outer plate 142 of wall 14 and the plate 18, and is sufficiently attractive to permit free-standing use of the cabinet as well as use against a wall. Furthermore, when the display cabinet is placed with the rear end of the end walls 16 against a wall, warm air from the blower 213 is exhausted through the holes H1 into the space defined by the gap G between the outer plate 142 of the rear wall 14 and the wall against which the cabinet is set.

The warm air exhausted by the blower 213 upwardly into the space defined by the gap G is directed onto the surface of the transparent cover panels 30 to prevent condensation thereon. To direct exhaust air onto the transparent cover panels 30, the upper wall 15 is provided with an air duct 40 between the upper plate 151 and the insulating element 152 within the upper wall 15. The air duct 40 has an outlet end 401 opening along the upper portion of the guide rail mechanism 31*a* onto the transparent cover panels 30 and an inlet end 402 communicating with the space defined by the gap G through inlet holes H2 formed through the upper plate 153 that may be integral with the upper wall 15 and forms a smooth continuation of the outer plate 142 of the rear wall 14.

The rear portion of the insulating element 152 is formed with a gradually increasing thickness towards the front opening 401 and, conversely, the depth of the air duct 40 is gradually decreased towards the front opening 401. A blower 41 is supported on a plate 43 at the inlet end 402 adjacent the holes H2 and functions to draw air from the space defined by the gap G through the holes H2 and forces it into the air duct 40 towards the outlet end 401. The warm air is thus circulated onto the outer surface of the transparent cover panels 30, thereby preventing condensation on the surfaces thereof.

Figure 4:
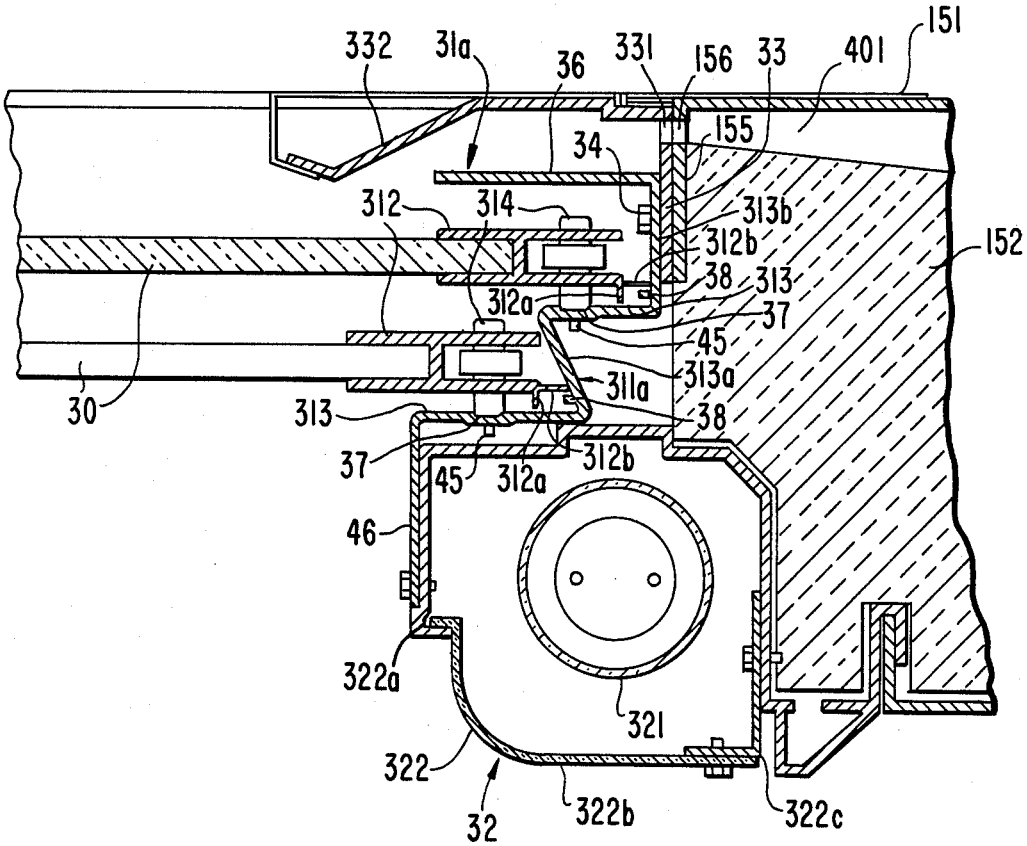
FIG. 4 is an enlarged cross-sectional view of the area A in FIG. 3.
Figure 5:
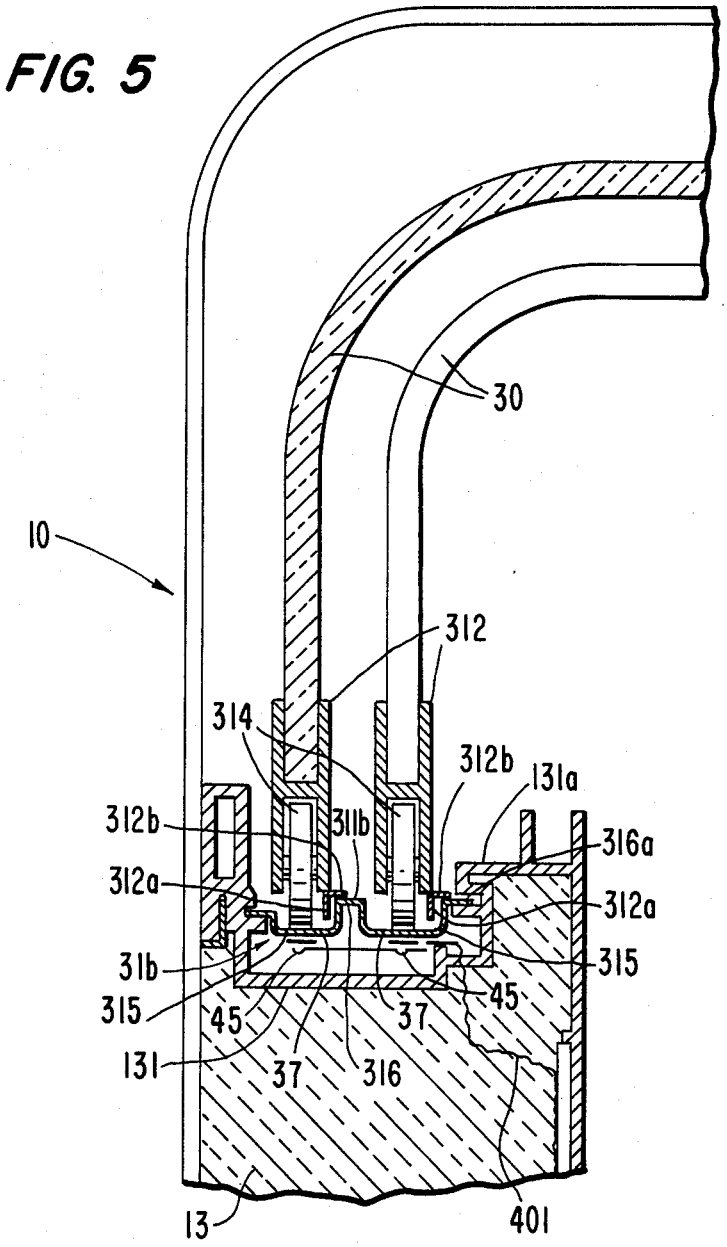
FIG. 5 is an enlarged cross-sectional view of the area B in FIG. 3.

Referring to FIGS. 4 and 5, each transparent cover panel 30 is formed L-shaped to cover the upper access opening 20*a* and is supported at its longitudinal edges on the upper wall 15 and the front wall 13 through guide rail mechanisms 31*a* and 31*b*, respectively. The rail mechanisms 31*a* and 31*b* for the transparent cover panels 30 comprise rail elements 311*a* and 311*b*, respectively, fixed to walls 15 and 13 and frames 312 attached to the edges of each of the transparent cover panels 30. The rail element 311*a* (FIG. 4) is fixed on the front end cover portion 155 of the upper plate 151 of upper wall 15 through support frame 33 by screws 34 through an attaching portion 313*b* thereof and provided with a horizontal flat running surface 313 for each of the transparent cover panels 30 and a connecting portion 313*a* between the running surfaces 313. The rail element 311*b* (FIG. 5) is fixed on the top of the front wall 13 and is provided with dual railways 315.

The frames 312 rotatably support wheels 314 which run on the running surfaces 313 of the rail element 311*a* and railways 315 of the rail element 311*b* whereby the transparent cover panels 30 are adapted to be moved relative to each other longitudinally of the cabinet. Also, each running surface 313 of the rail element 311*a* and the railways 315 of the rail element 311*b* are provided with a depression 37 for each of the wheels 314 in which the wheels rests when the transparent cover panels 30 are fully closed, thereby holding the cover panels 30 in their closed positions.

A plurality of holes 156 and 311 (FIG. 4) are formed through the front end portion 155 of the upper plate 151 and the support frame 33, and the upper end portion of the support frame 33 has a flange portion 332 extending horizontally over the edge of the transparent cover panels 30 for directing warm air flowing from the outlet opening 401 onto the outer surface of the transparent cover panels 30. Some of the warm air flowing from the outlet opening 401 tends to enter into the refigerating chamber 20 through the rail element 311*a*. To avoid this, the rail element 311*a* has an air guide element 36 extended horizontally from the upper end thereof over the frames 312 and the wheels 314 carried thereby to form with the flange portion 332 of support frame 33 a passageway for the air.

The rail elements 311*a* and 311*b* are provided with sealing means which comprise two sealing flanges 312*a* and 312*b* extending from the bottom edge of each frame 312 to prevent leakage of cold air from the refrigerating chamber 20. The sealing flanges 312*a* extend vertically from the lower corner of the frame 312 and are adapted to contact running surfaces 313 of rail element 311*a* and railways 315 of rail elements 311*b*. The other sealing flanges 312*b* extend horizontally from the lower corner of the frame 312 and are adapted to contact a projection 38 extending outwardly from the outer surface of the connecting portion 313*a* of the rail element 311*a* or either a connecting portion 316 or a flange 316*a* of the rail element 311*b* when the wheels 314 are seated in the depressions 37. Thus, the gaps between the rail elements 311*a* and 311*b* and the frames 312 are sealed when the transparent cover panels are positioned to close the access opening 20*a* of the refrigerating chamber 20.

Furthermore, each rail element 311*a* and 311*b* is formed of high thermal conductive material, and an electrical heater 45 is disposed beneath each of the running surfaces 313 of the rail elements 311*a* and the railways 315 of rail elements 311*b* to prevent freezing of the wheels 314 and frames 312 on the rail elements 311*a* and 311*b*.

As shown in FIG. 5, the rail element 311*b* is disposed on an upper edge panel 131 on the front wall 13 with a gap to provide space for mounting the heater 45 on the bottom surface of the rail element 311*b*. More particularly, the edge panel 131 is formed substantially U-shaped in cross section and rail element 311*b* is supported on ledges midway up the legs of the panel 131. Accordingly, water condensing on the cover panels 30 drains into and is accumulated in the well formed by the raceways 315 in the rail element 311*b* and in the U-shaped panel 131 and does not submerged the heater 45. Power for the heaters 45 on the railways 315 is provided by a lead wire 401 extending upwardly from the wall 13 and across a ledge spaced from the bottom wall of the panel 131 so that the lead wire 401 also is not submerged in the condensation draining from the cover panels 30.

Illuminating means 32 is affixed on the front end of the upper wall 15 below the guide rail element 311*a* and comprises a series of fluorescent lamps 321 and a three-part cover frame 322 consisting of an upper cover plate 322*a*, a lower cover plate 322*b* and a connecting element 322*c*. The upper cover plate 322*a* is attached on the front of the upper wall 15 to position a lamp 321 in the refrigerating chamber and thus provide illumination for the merchandise displayed therein. As shown in FIG. 4, the face of the rail element 311*a* extends over and covers the front portion of the upper cover plate 322*a* and is provided with a mirror surface 46 that reflects the merchandise in the refrigerating cabinet 20 to the customer. The mirror surface 46 is kept from defogging because it is integral with the rail element 311*a* which in turn is heated by the heater 45.

This invention has been described in detail in connection with the preferred embodiment, but this embodiment is merely for example only and the invention is not restricted thereto. It will be understood by those skilled in the art that other variations and modifications can be made within the scope of this invention as defined by the appended claims.

I claim:

1. In a refrigerated display cabinet to store and display merchandise including a refrigerating chamber defined by a front wall, a rear wall, a bottom wall extending between the lower portions of said front and rear walls, a pair of side walls and an upper wall partly covering the upper portion thereof and a mechanical chamber in which the refrigerating apparatus is located, an access opening into said refrigerating chamber adapted to be opened and closed by transparent cover panels mounted on said upper and front walls for sliding longitudinally of the access opening by guide rail mechanisms, said guide rail mechanisms including frames attached on the horizontal edges of said transparent cover panels and rotatably supporting at least two wheels, and rail elements affixed on the edges of said front and upper walls and provided with surfaces to guide the movement of said wheels and including a rail element affixed to the edge of said upper wall and having two horizontally disposed flat running surfaces for said wheels, a connecting portion between said flat running surfaces, and an attaching portion extending vertically upwardly from one of said surfaces, the improvement comprising each of said frames being provided with two sealing flanges extending from an edge thereof, one of said flanges extending vertically and the other of said flanges extending horizontally, projections formed on said connecting portions and said attaching portions, respectively, each of said flanges being adapted to contact a surface of the respective rail element when said transparent cover panel is in position to close said access opening, the horizontally extending sealing flanges associated with said rail element affixed to the edge of said upper wall being adapted to contact and to ride along the upper surface of the respective projections.

2. The refrigerated display cabinet of claim 1 wherein an illuminating means is disposed in said refrigerating chamber below said rail element and attached on said upper wall, and said rail element being formed of high thermal conductive material and provided with a depending portion partly covering the front of said illuminating device and having a mirror surface.

3. The refrigerated display cabinet of claim 1 wherein an edge panel is provided on the upper edge of said front wall and has a U-shaped cross section, said rail element being disposed on said edge panel in spaced relation to the bottom thereof to define a gap, and electrical heaters disposed along the bottom surfaces of said rail elements.

4. The refrigerated display cabinet of claim 3 wherein said edge panel has a lead wire disposed in spaced relation to the bottom thereof to energize said heaters.

* * * * *